US008520881B2

(12) United States Patent
Nikles et al.

(10) Patent No.: US 8,520,881 B2
(45) Date of Patent: Aug. 27, 2013

(54) HEARING APPARATUS WITH LOW-INTERFERENCE RECEIVER CONTROL AND CORRESPONDING METHOD

(75) Inventors: Peter Nikles, Erlangen (DE); Gottfried Rückerl, Nürnberg (DE); Ulrich Schätzle, Forchheim (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 1331 days.

(21) Appl. No.: 12/148,096

(22) Filed: Apr. 16, 2008

(65) Prior Publication Data

US 2009/0010473 A1 Jan. 8, 2009

Related U.S. Application Data

(60) Provisional application No. 60/923,681, filed on Apr. 16, 2007.

(51) Int. Cl.
*H01R 25/00* (2006.01)

(52) U.S. Cl.
USPC ..... 381/370

(58) Field of Classification Search
USPC ..... 381/370–380
See application file for complete search history.

(56) References Cited

U.S. PATENT DOCUMENTS

| | | | | |
|---|---|---|---|---|
| 6,157,727 | A * | 12/2000 | Rueda | 381/312 |
| 6,605,991 | B2 | 8/2003 | Midya et al. | |
| 2004/0109577 | A1 | 6/2004 | Husung et al. | |
| 2004/0202333 | A1 * | 10/2004 | Csermak et al. | 381/60 |
| 2006/0072658 | A1 * | 4/2006 | Yasuda et al. | 375/238 |
| 2006/0104463 | A1 | 5/2006 | Roeck et al. | |

FOREIGN PATENT DOCUMENTS

| | | | |
|---|---|---|---|
| CN | 1527500 | A | 9/2004 |
| CN | 1883172 | A | 12/2006 |
| EP | 0 823 829 | A2 | 2/1998 |
| EP | 1860914 | A1 | 11/2007 |
| JP | 10174195 | A | 6/1998 |
| JP | 2006217088 | A | 8/2006 |
| WO | 03021770 | A1 | 3/2003 |
| WO | 2006003550 | A1 | 1/2006 |
| WO | 2006074655 | A1 | 7/2006 |

OTHER PUBLICATIONS

Klaus David, Thorsten Benkner; "Digitale Mobilfunksysteme"; 1996; pp. 326-329; B.G. Teubner Verlag Stuttgart; ESBN 3-519 06181-3.

Office action from Chinese Patent Office and English translation, Jul. 19, 2011, pp. 1-12.

* cited by examiner

*Primary Examiner* — Tuyen Nguyen

(57) ABSTRACT

A power-saving control of the receiver in hearing devices with wireless transmission to other devices is also to be possible without significant interferences. Provision is thus made in accordance with the invention for a hearing apparatus, in particular a hearing device, with a transmission facility for wireless data transmission in a main frequency band, a loudspeaker and a control facility for controlling the loudspeaker with a control signal, with the frequency spectrum of the control signal having a significant notch in the range of the main frequency band. A "noise-shaping" of this type can be achieved by pulse-density modulated receiver control signals.

14 Claims, 3 Drawing Sheets

HEARING APPARATUS WITH LOW-INTERFERENCE RECEIVER CONTROL AND CORRESPONDING METHOD

CROSS REFERENCE TO RELATED APPLICATIONS

The present application claims the benefit of the provisional patent application filed on Apr. 16, 2007, and assigned application No. 60/923,681, which is incorporated by reference herein in its entirety.

FIELD OF THE INVENTION

The present invention relates to a hearing apparatus with a transmission unit for wireless data transmission in a main frequency band, a loudspeaker and a control facility for controlling the loudspeaker using a control signal. The present invention also relates to a corresponding method for operating a hearing apparatus. The term "hearing apparatus" is understood here to mean in particular a hearing device, a headset, earphones and other devices which can be worn on the head.

BACKGROUND OF THE INVENTION

Hearing devices are portable hearing apparatuses which are used to supply the hard-of-hearing. To accommodate the numerous individual requirements, different configurations of hearing devices such as behind-the-ear hearing devices (BTE), in-the-ear hearing devices (ITE), e.g. including conch hearing devices or completely-in-the-channel hearing devices (CIC), are provided. The hearing devices designed by way of example are worn on the outer ear or in the auditory canal. Furthermore, bone conduction hearing aids, implantable or vibrotactile hearing aids are also available on the market. In such cases the damaged hearing is stimulated either mechanically or electrically.

Essential components of the hearing devices include in principle an input converter, an amplifier and an output converter. The input converter is generally a receiving transducer, e.g. a microphone and/or an electromagnetic receiver, e.g. an induction coil. The output converter is mostly realized as an electroacoustic converter, e.g. a miniature loudspeaker, or as an electromechanical converter, e.g. a bone conduction receiver. The amplifier is usually integrated into a signal processing unit. This basic configuration is shown in the example in FIG. 1 of a behind-the-ear hearing device. One or a number of microphones 2 for recording the ambient sound are incorporated in a hearing device housing 1 to be worn behind the ear. A signal processing unit 3, which is similarly integrated into the hearing device housing 1, processes the microphone signals and amplifies them. The output signal of the signal processing unit 3 is transmitted to a loudspeaker and/or receiver 4, which outputs an acoustic signal. The sound is optionally transmitted to the ear drum of the device wearer via a sound tube, which is fixed with an otoplastic in the auditory canal. The power supply of the hearing device and in particular of the signal processing unit 3 is provided by a battery 5 which is likewise integrated into the hearing device housing 1.

The pulse-density modulation (PDM) or pulse-width modulation (PWM) is frequently used to control the loudspeaker and/or receiver of a hearing device for instance. The digital control is advantageous in that the stage of the digital-analog converter can be dispensed with in the case of digital hearing devices. Digital control circuits also have a significantly higher efficiency rate than analog control circuits. By contrast, analog control circuits are less prone to interference, i.e. they occupy a frequency spectrum which is restricted to an acoustic signal with a small harmonic wave part. The very strongly developed harmonic waves in the case of digital control nevertheless interfere with the wireless transmission of data between hearing devices and the transmission between a hearing device and an external accessory (remote controller, wireless programming device, wireless relay device etc.).

One possible solution to this problem could lie in the following compromise: The receiver is controlled analogously in the case of hearing devices with wireless transmission and in the case of hearing devices without the wireless function, a power-saving digital control takes place. Hearing devices with wireless transmission may however thus not profit from the power-saving digital control.

SUMMARY OF THE INVENTION

The object of the present invention thus consists in enabling a power-saving digital control of the loudspeaker of the hearing apparatus, also especially for digitally operating hearing apparatuses. A corresponding method for operating a hearing apparatus is also to be provided.

This object is achieved in accordance with the invention by a hearing apparatus with a transmission facility for wireless data transmission in a main frequency band, a loud speaker and a control facility for controlling the loudspeaker with a control signal, with the frequency spectrum of the control signal having a significant notch in one range of the main frequency band.

Provision is also made in accordance with the invention for a method for operating a hearing apparatus by wirelessly transmitting data in a main frequency band and controlling a loudspeaker of the hearing apparatus with a control signal, with the frequency spectrum of the control signal having a significant notch in one range of the main frequency band.

By separating the signals for the data transmission and for the control of the loudspeaker in the frequency range, alternate interferences hardly occur any more so that a hearing apparatus, which is designed for wireless data transmission, can also digitally control the internal receiver and/or loudspeaker.

The control signal of the control facility is preferably pulse-density modulated or pulse-width modulated. An inductive loudspeaker which operates as a low pass can thus be controlled by a digital signal processing circuit without considerable signal processing outlay.

The data transmission through the transmission facility can take place in a broadband fashion in several frequency bands and the frequency spectrum of the control signal can have a significant notch in the range of each of the frequency bands in each instance. The principle according to the invention can thus also be applied to a broadband transmission of high data rates.

The transmission facility can also comprise a band pass filter, which essentially only allows frequency parts to pass, which lie in the main frequency band or in the main frequency band and in the range of multiples thereof. The interference resistance of the wireless transmission can herewith be additionally increased.

In a special embodiment, the hearing apparatus according to the invention can be configured as an in-the-ear hearing device, even if the current consumption there and the space available are extremely limited. The minimal space available forces the receiver, which is generally a magneto-acoustic converter, very close to the receiver coil. The position and alignment with each device is also individual with in-the-ear hearing devices. In any case, the receiver induces more or less large interference signals into the receiver coil. The signal-to-noise ratio there is thus generally clearly impaired. The poor signal-to-noise ratio could be improved by an increased transmission power, which can however only be achieved by an enormous energy requirement. Therefore the inventive solution involving spectrally separating the control signal for the receiver from the transmission signal for the wireless data transmission is even more welcome.

According to a further embodiment, a hearing system with two hearing devices is provided in accordance with the invention, which each have the design of the hearing apparatus described above, with the transmission facilities of both hearing devices allowing a bidirectional, wireless data transmission and a data transmission in one direction taking place in a different frequency band to a data transmission in the other direction. A real bidirectional connection can thus be made available with synchronized directional transmissions.

BRIEF DESCRIPTION OF THE DRAWINGS

The present invention is described in more detail on the basis of the appended drawings, in which.

DETAILED DESCRIPTION OF THE INVENTION

The exemplary embodiments illustrated below represent preferred embodiments of the present invention.

Figure 1:
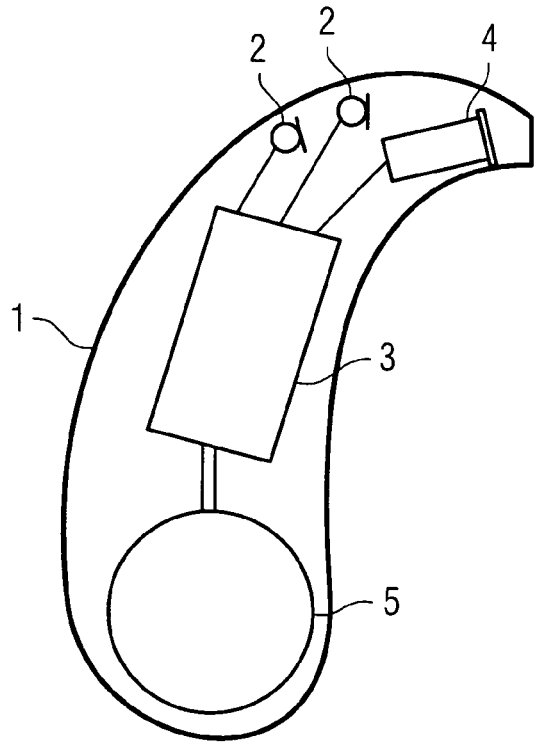
FIG 1 (Prior art)
FIG. 1 shows the basic design of a hearing device according to the prior art.
Figure 2:
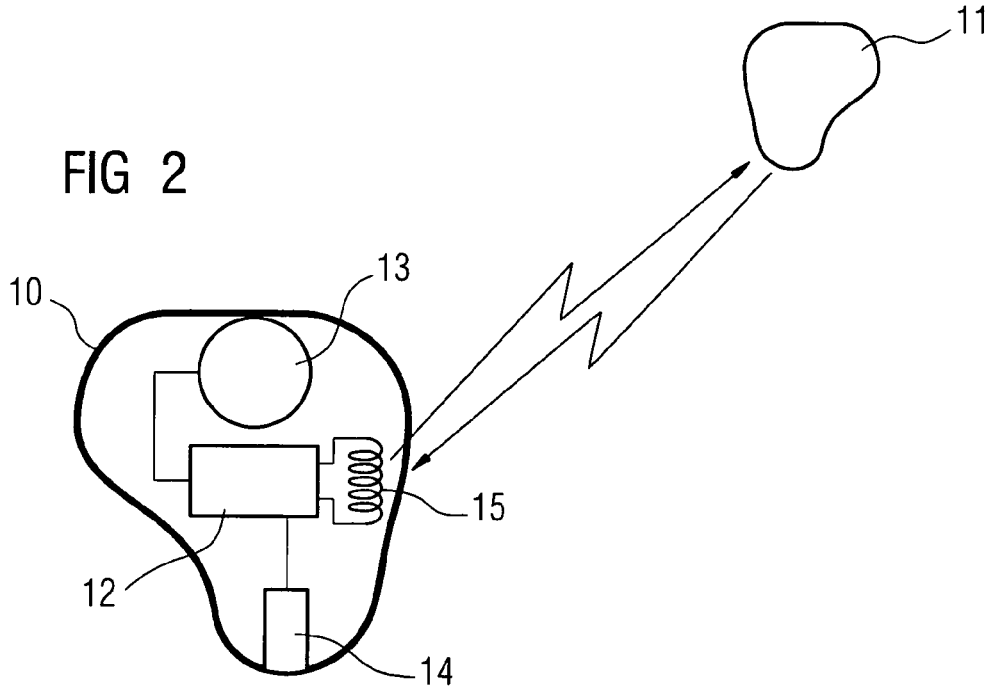
FIG. 2 shows a hearing device system according to the invention.

FIG. 2 shows a schematic representation of a hearing device system with two hearing devices 10 and 11. The two hearing devices 10, 11 are of an identical design. For the sake of clarity, only the components which are essential to the present invention are shown in the hearing device 10. The central unit of the ITE hearing device 10 is a signal processing unit and/or control unit 12. It is powered by a battery 13. Its output signal is used to control a receiver 14, which is generally designed as a magneto-acoustic converter. Furthermore, the control unit 12 also controls a transmission unit 15, which is used here for the bidirectional transmission to the second hearing device 11. The transmission facility 15 is symbolized by a coil, it can however also contain other transmission components.

FIG. 2 shows that the electronic components in the ITE hearing device 10 are arranged spatially very close to one another. In particular, the receiver 14 and the transmission unit 15 are also positioned very close together, thereby resulting in involuntary mutual influences and interferences.

Figure 3:
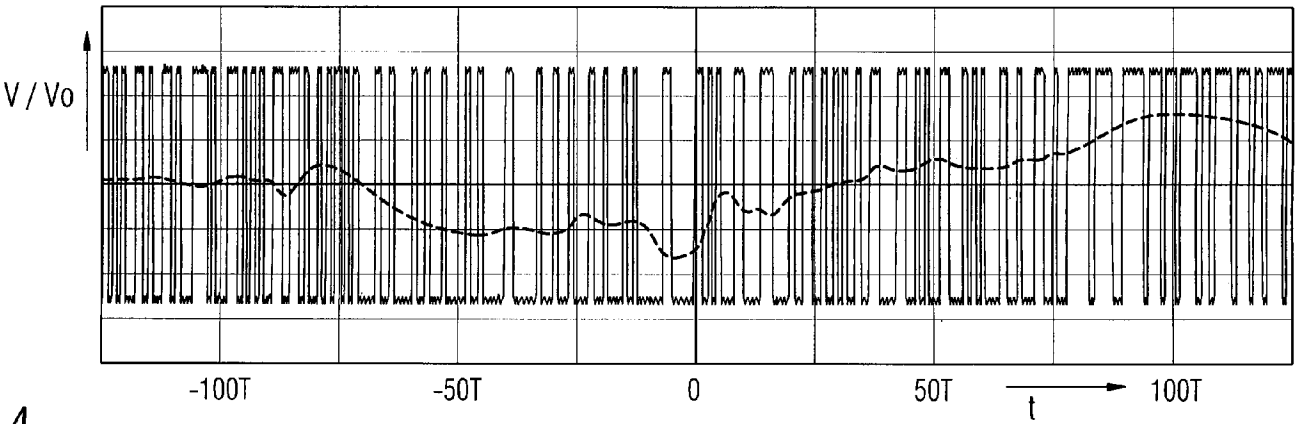
FIG. 3 shows a PDM time signal of the voltage at the receiver
Figure 4:
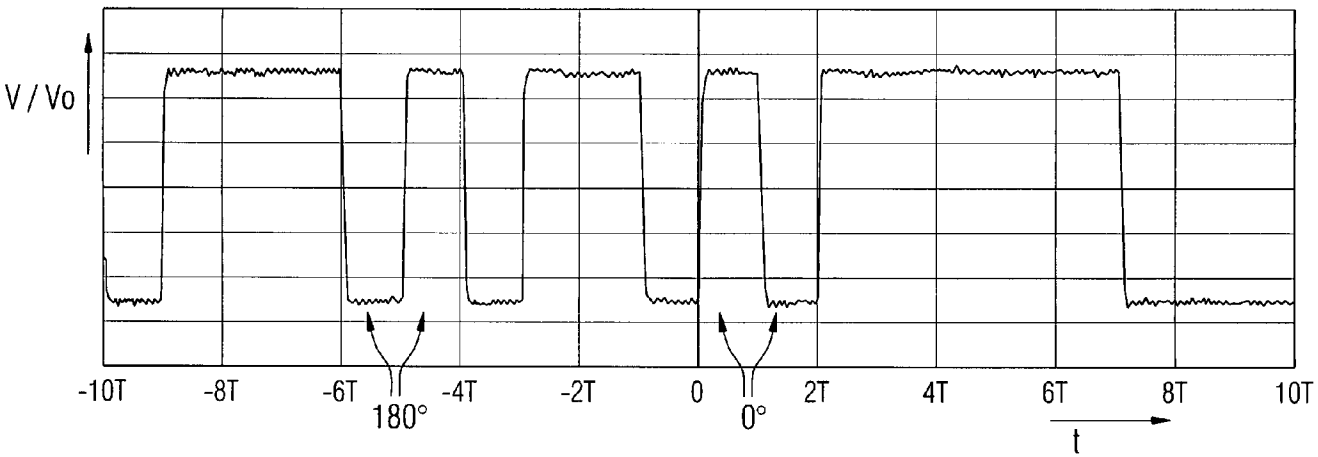
FIG. 4 shows an enlarged cutout of the PDM time signal in FIG. 3.

FIG. 3 shows a typical PDM control signal, with which the control unit 12 temporally controls the receiver 14. The information to be transmitted to the receiver pushes into the pulse density. FIG. 4 shows an enlarged representation of a cutout of this signal. The density of the pulses varies in the desired manner.

The receiver 14 has a specific inductive characteristic. The temporal PDM voltage signal in the receiver and reproduced in FIG. 3 thus produces the current trend illustrated with a dashed line in the FIG.

Figure 5:
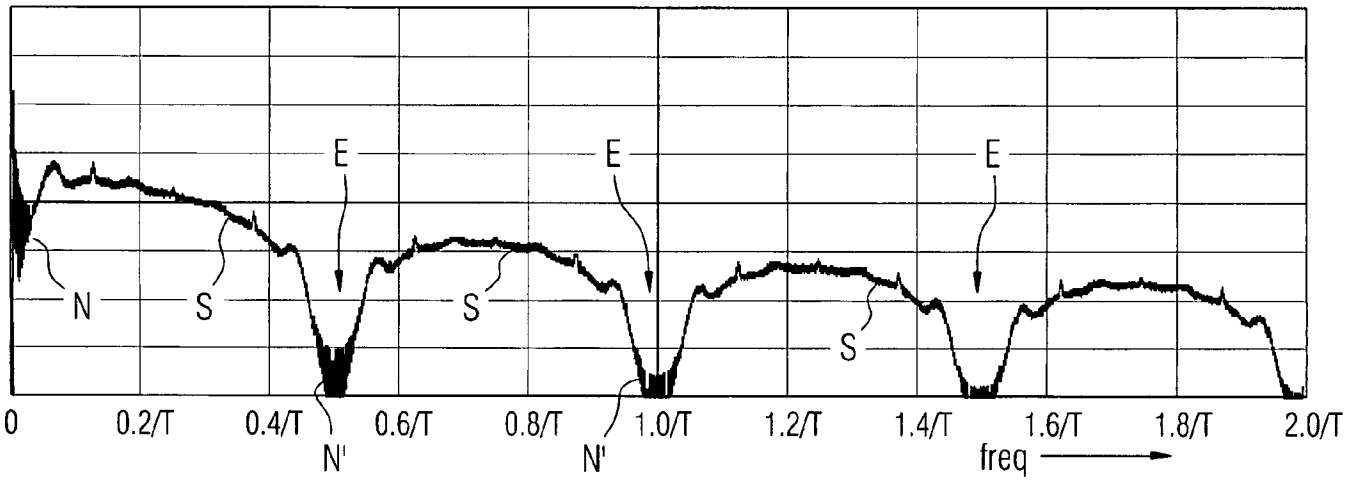
FIG. 5 shows the PDM frequency spectrum of the signal in FIG. 3.

The frequency spectrum of the PDM voltage signal of FIG. 3 is shown in FIG. 5. It essentially consists of arcs, which are periodically arranged in rows next to one another and the amplitudes of which reduce as a result of the rectangular shape of the PDM pulses according to the function sin x/x. In certain ranges of the spectrum, namely between two arcs, notches E result in the spectrum, i.e. so-called "freely spaced regions". In these freely spaced regions, none or hardly any interference signals occur. Only the wanted signal N and/or wanted signal parts N' are then present there. The emergence of notches E can also be explained as follows: The pulse durations Tp of the PDM signal are fixedly selected and appear in a fixed time period of $n \times Tp$. The statistical distribution of positive and negative pulses is identical for natural audio signals. The frequency 1/(2 Tp) as well as its whole-number multiples herewith appear with approximately the same amplitude in the phase position 0° and 180°. This results in the targeted deletion of signals in the range around the frequencies $n \times 1/(2\,Tp)$. This deletion results in the aforementioned "notches". The arched interference signal parts S are produced in between.

The basic idea of the present invention now consists in adjusting the working frequency of the digital receiver control to the wireless transmission system. A concrete attempt is thus made to remove interfering receiver noise parts from the used frequency band for the wireless data transmission. This is achieved here by the corresponding favorable shaping of the interference spectrum ("noise shaping") by the working frequency of the PDM modulator likewise being selected such that the notches E lie in the range of the transmission frequency for the wireless transmission and/or the multiples thereof. The wireless transmission is thus again only marginally impaired and the advantages of the digital receiver control remain.

The spaces of the interference parts from the frequency ranges used for the wireless data transmission can be supplemented by additionally known "noise-shaping" methods. Thus for example noise parts from the low-frequency range of audio signals can knowingly be moved in the direction of higher frequencies. This and other known methods thus allow the width and shape of the notches to be optimized in each instance.

Figure 6:
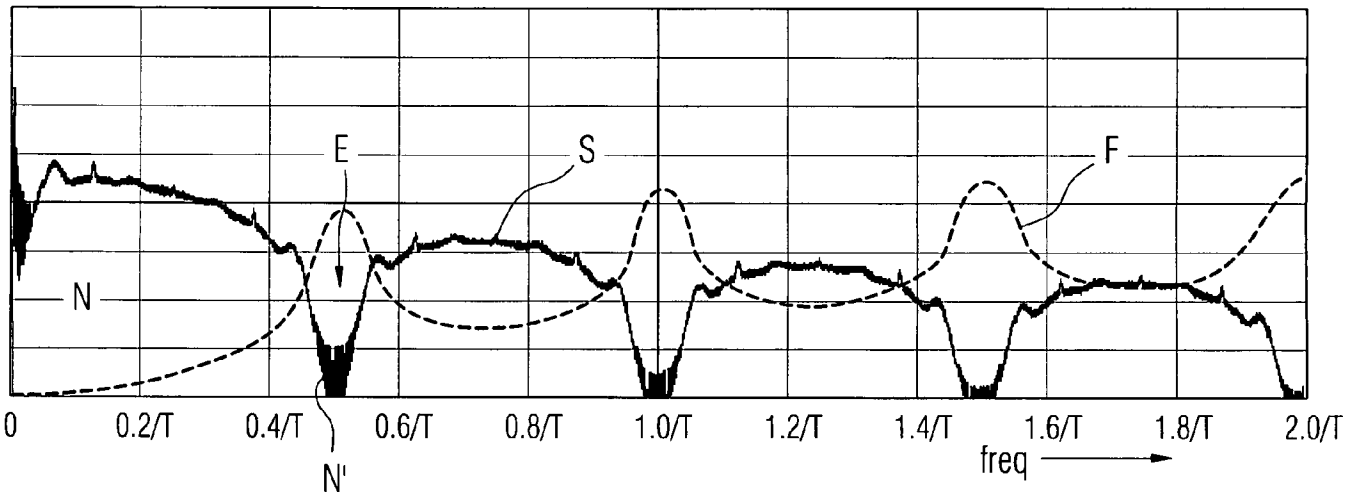
FIG. 6 shows the PDM frequency spectrum of FIG. 5 together with an admission curve of an ideally adjusted frequency filter.

The interference resistance of the wireless transmission against the receiver control can be further improved by the signal processing of the wireless transmission part being embodied with a bandpass filter, which only allows frequencies within the wirelessly used bandwidth to pass unobstructed. The filter function F of a bandpass filter of this type is shown in FIG. 6 together with the PDM frequency spectrum of the exemplary signal. The improvement in interference resistance is particularly effective if the characteristics of the bandpass (increase in filter edges, quality of the filter) are adjusted in respect of each other.

In the example in FIG. 5, "notches" occur in fixed frequency intervals. In the simplest case, only one of these is used for the wireless data transmission. For applications with large bandwidth requirements, the wireless transmission can however also be divided into several component frequency ranges. The component frequency ranges are then to lie in other "notches" of the PDM control signal for the receiver. In respect of the interference resistance, the characteristics of the bandpass and those of the "noise-shaping" are to be adjusted here to one another. This can be achieved for instance with special comb filters, the pass-band widths of which are attuned to the "notches".

Following the filtering process, an even, low basic noise level, from which small wanted signals can also still be readily detected, is achieved. The possible coverage of the wireless transmission increases as a result. Alternatively, a higher data rate can be achieved with the same coverage.

The fact that bandwidth-intensive transmissions of audio signals or programming data are possible for applications in which several frequency ranges are used was already indicated above. If necessary, several frequency bands can however also be used for synchronized bidirectional transmissions, by the directions being divided up across different frequency ranges.

The invention claimed is:

1. A hearing apparatus, comprising:

a transmission unit that wirelessly transmits data in a frequency band;

a loudspeaker; and a control unit that controls the loudspeaker with a control signal having a frequency spectrum notched in a range of the frequency band to avoid interference with the data in the frequency band, the frequency spectrum notched without use of a notch filter.

2. The hearing apparatus as claimed in claim 1, wherein the control signal is pulse-density modulated.

3. The hearing apparatus as claimed in claim 1, wherein the data is transmitted in several frequency bands.

4. The hearing apparatus as claimed in claim 3, wherein the frequency spectrum of the control signal is notched in a range of each of the frequency bands to avoid interference with the data in each frequency band, the frequency spectrum notched without use of a notched filter.

5. The hearing apparatus as claimed in claim 1, wherein the transmission unit comprises a band pass filter that passes a frequency part in the frequency band or in the range of the frequency band.

6. The hearing apparatus as claimed in claim 1, wherein the hearing apparatus is an in-the-ear hearing device.

7. A hearing system, comprising:

a first hearing device; and a second hearing device, wherein the first and the second hearing device each comprises:

a transmission unit that wirelessly transmits data in a frequency band;

a loudspeaker; and a control unit that controls the loudspeaker with a control signal having a frequency spectrum notched in a range of the frequency band to avoid interference with the data in the frequency band, the frequency spectrum notched without use of a notch filter.

8. The hearing system as claimed in claim 7, wherein the transmission unit of the first and the second hearing device transmits data bidirectionally.

9. The hearing system as claimed in claim 8, wherein the data is transmitted in one direction in a frequency band that is different than in another direction.

10. A method for operating a hearing apparatus, comprising:

wirelessly transmitting data in a frequency band; and controlling a loudspeaker of the hearing apparatus with a control signal having a frequency spectrum notched in a range of the frequency band to avoid interference with the data in the frequency band, the frequency spectrum notched without use of a notch filter.

11. The method as claimed in claim 10, wherein the control signal is pulse-density modulated.

12. The method as claimed in claim 10, wherein the data is transmitted in several frequency bands.

13. The method as claimed in claim 12, wherein the frequency spectrum of the control signal is notched in a range of each of the frequency bands to avoid interference with the data in each frequency band, the frequency spectrum notched without use of a notch filter.

14. The method as claimed in claim 10, wherein the transmission unit comprises a band pass filter that passes a frequency part in the frequency band or in the range of the frequency band.

* * * * *